United States Patent [19]

Watanabe et al.

[11] Patent Number: 4,877,497

[45] Date of Patent: Oct. 31, 1989

[54] ACIDIC ELECTRO-GALVANIZING SOLUTION

[75] Inventors: Tsutomu Watanabe; Akihiko Furuta, both of Tokyo, Japan

[73] Assignee: NKK Corporation, Tokyo, Japan

[21] Appl. No.: 273,910

[22] Filed: Nov. 18, 1988

[51] Int. Cl.[4] ..... C25D 3/22

[52] U.S. Cl. ..... 204/55.1

[58] Field of Search ..... 204/55.1, 44.2, 28

[56] References Cited

FOREIGN PATENT DOCUMENTS 57-89493 6/1982 Japan .
278290 12/1987 Japan .

*Primary Examiner*—G. L. Kaplan

*Attorney, Agent, or Firm*—Frishauf, Holtz, Goodman & Woodward

[57] ABSTRACT

An acidic aqueous electro-galvanizing solution consisting essentially of:

Zinc chloride: from 100 to 400 g/l, at least one substance selected from the group consisting of ammonium chloride and potassium chloride: from 100 to 400 g/l, and at least one substance selected from the group consisting of saturated carboxylic acid, sodium salt thereof and potassium salt thereof: from 1 to 70 g/l.

The above-mentioned electro-galvanizing solution permits manufacture of an electro-galvanized steel sheet having a satisfactory quality by largely inhibiting production of an anode sludge.

10 Claims, 3 Drawing Sheets

ACIDIC ELECTRO-GALVANIZING SOLUTION

As far as we know, there is available the following prior art document pertinent to the present invention:

Japanese Patent Provisional Publication No. 57-89,493 dated June 3, 1982.

The contents of the prior art disclosed in the above-mentioned prior art document will be discussed hereafter under the heading of the "BACKGROUND OF THE INVENTION."

FIELD OF THE INVENTION

The present invention relates to a zinc chloride electro-galvanizing solution as an acidic electro-galvanizing solution known as a chloride galvanizing solution, which is used when continuously electro-galvanizing a steel sheet at a high speed.

BACKGROUND OF THE INVENTION

It is the conventional practice to use a zinc sulfate electro-galvanizing solution mainly comprising zinc sulfate (hereinafter referred to as the "sulfate galvanizing solution") as an acidic electro-galvanizing solution. The sulfate galvanizing solution has the following defects as compared with a zinc chloride electro-galvanizing solution comprising zinc chloride and other chlorides (hereinafter referred to as the "chloride galvanizing solution"):

(1) a very low electric conductivity;

(2) requiring an excessive voltage as the bath voltage in order to obtain a prescribed electro-galvanizing current density, thus resulting in a high electric power cost;

(3) a low allowable electro-galvanizing current density making it difficult to electro-galvanize a steel sheet at a high speed.

As compared with the sulfate galvanizing solution, on the other hand, the chloride galvanizing solution is very corrosive and easily causes corrosion of a galvanizing tank or a piping of an electro-galvanizing apparatus. Adoption of the chloride galvanizing solution has therefore been hesitated. Recently, however, there has been made a remarkable progress in the development of materials having an excellent corrosion resistance to acids, and as a result, adoption of the chloride galvanizing solution is being reconsidered.

However, application of continuous electro-galvanizing to a steel sheet at a high speed with the use of the chloride galvanizing solution involves the following problems.

When electro-galvanizing a steel sheet using the chloride galvanizing solution, a zinc electrode is employed as a soluble anode. A scaly black sludge (hereinafter referred to as the "anode sludge") in a very large amount is produced on the surface of the zinc electrode in the chloride galvanizing solution. More particularly, the chloride galvanizing solution has an electric conductivity for higher than that of the sulfate galvanizing solution and contains much chlorine ions, so that the chloride galvanizing solution has a corrosivity far higher than that of the sulfate galvanizing solution. Therefore, when continuously electro-galvanizing a steel sheet using the chloride galvanizing solution, $Fe^{2+}$ ions in a far larger amount than in the sulfate galvanizing solution are dissolved from the surface of the steel sheet into the chloride galvanizing solution, and are accumulated therein. Since a local battery is formed on the surface of the zinc electrode even when electricity is on, these $Fe^{2+}$ ions are easily replaced into metallic iron which precipitates on the surface of the zinc electrode. Because of the high dissolving rate and the high electric conductivity of zinc, production and separation of a scaly metallic iron onto and from the surface of the zinc electrode are repeated at a frequency far higher than in the sulfate galvanizing solution, and the anode sludge is thus produced in a very large amount.

The anode sludge separated from the surface of the zinc electrode floats in the chloride galvanizing solution. The anode sludge thus floating in the chloride galvanizing solution adheres onto the surface of the electro-galvanized steel sheet to stain the surface thereof or adheres onto the surfaces of the rolls of the electro-galvanizing apparatus to form dent defects on the surface of the electro-galvanized steel sheet. In addition, the anode sludge floating in the chloride galvanizing solution adheres onto the pump and the piping of the electro-galvanizing apparatus to cause clogging or is dissolved again into the chloride galvanizing solution as impurity ions. The anode sludge thus impairs smooth operation of electro-galvanizing and degrades quality of the electro-galvanized steel sheet.

As a chloride galvanizing solution for improving the exterior appearance of an electro-galvanized steel sheet, Japanese Patent Provisional Publication No. 57-89,493 dated June 3, 1982 discloses an acidic electro-galvanizing solution comprising:

zinc chloride ($ZnCl_2$) from 100 to 300 g/(, and at least one substance selected from the group consisting of ammonium chloride ($NH_4Cl$), potassium chloride (KCL), sodium chloride (NaCl), aluminum chloride ($AlCl_3$), barium chloride ($BaCl_2$), calcium chloride ($CaCl_2$), magnesium chloride ($MgCl_2$), managanese chloride ($MnCl_2$) and iron chloride ($FeCl_2$, $FeCl_3$): from 100 to 400 g/l;

pH value of said acidic electro-galvanizing solution being adjusted within the range of from 1.0 and 3.5.

(hereinafter referred to as the "Prior Art")

However, the Prior Art cannot solve the problems mentioned above regarding production of the anode sludge. More specifically, the chloride galvanizing solution as the acidic electro-galvanizing solution according to the Prior Art does not contain a constituent having the function of inhibiting production of the anode sludge. Furthermore, this chloride galvanizing solution, having a low pH value within the range of from 1.0 to 3.5, is very highly corrosive. As a result, when electro-galvanizing a steel sheet with the use of the chloride galvanizing solution according to the Prior Art, not only $Fe^{2+}$ ions are dissolved from the surface of the steel sheet into the chloride galvanizing solution, but also metallic ions are dissolved from the metal parts of the electro-galvanizing apparatus which are in contact with the chloride galvanizing solution, and a local battery tends to be formed on the surface of the zinc electrode, so that the amount of the produced anode sludge seriously increases. In addition, as the chloride galvanizing solution has a low pH value as described above, the produced anode sludge is liable to be easily dissolved again into the chloride galvanizing solution. It is therefore inevitable that a large amount of ions of impurities are accumulated in the chloride galvanizing solution.

Under such circumstances, there is a strong demand for the development of an acidic electro-galvanizing solution which permits manufacture of an electro-galvanized steel sheet having a satisfactory quality by largely inhibiting production of the anode sludge, which is the most detrimental defect of the conventional chloride galvanizing solution, without impairing the low electric power cost and the high productivity, which are the favorable merits of the chloride galvanizing solution, but such an electro-galvanizing solution has not as yet been proposed.

SUMMARY OF THE INVENTION

An object of the present invention is therefore to provide an acidic electro-galvanizing solution which permits manufacture of an electro-galvanized steel sheet having a satisfactory quality by largely inhibiting production of the anode sludge, which is the most detrimental defect of the conventional chloride galvanizing solution, without impairing the low electric power cost and the high productivity, which are the favorable merits of the chloride galvanizing solution.

In accordance with one of the features of the present invention, there is provided an acidic electro-galvanizing solution, characterized by consisting essentially of:

zinc chloride: from 100 to 400 g/l, at least one substance selected from the group consisting of ammonium chloride and potassium chloride: from 100 to 400 g/l, and at least one substance selected from the group consisting of saturated carboxylic acid, sodium salt thereof and potassium salt thereof: from 1 to 70 g/l.

DETAILED DESCRIPTION OF PREFERRED EMBODIMENTS

Figure 1:
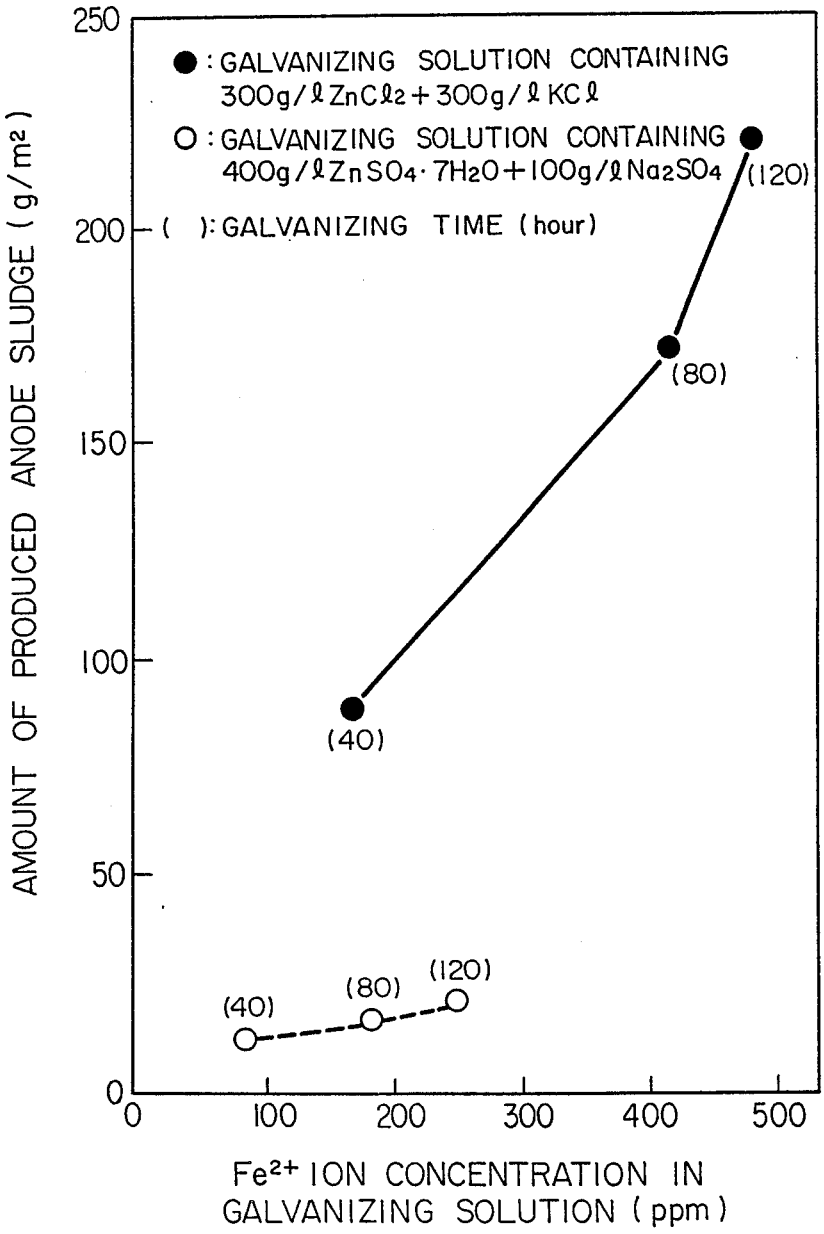
FIG. 1 is a graph illustrating the relationship between the $Fe^{2+}$ ion concentration and the amount of the produced anode sludge in a galvanizing solution when a steel sheet is electro-galvanized with the use of the sulfate galvanizing solution and the chloride galvanizing solution which does not contain any of saturated carboxylic acid, sodium salt thereof and potassium salt thereof.

From the above-mentioned point of view, extensive studies were carried out to develop an acidic electro-galvanizing solution which permits manufacture of an electro-galvanized steel sheet having a satisfactory quality by largely inhibiting production of the anode sludge, which is the most detrimental defect of the conventional chloride galvanizing solution, without imparing the low electric power cost and the high productivity, which are the favorable merits of the chloride galvanizing solution.

As a result, the following finding was obtained. More particularly, it is possible to inhibit production of the anode sludge by preventing replacement and precipitation of $Fe^{2+}$ ions since the anode sludge is produced through replacement of ions of metal, which is nobler than zinc in the chloride galvanizing solution, into the metal and precipitation thereof, particularly through replacement of $Fe^{2+}$ ions into metallic iron and precipitation thereof, and in addition, saturated carboxylic acid, sodium salt thereof and potassium salt thereof have the function of preventing the above-mentioned replacement and precipitation of $Fe^{2+}$ ions.

The present invention was developed on the basis of the above-mentioned finding, and the acidic electro-galvanizing solution of the present invention consists essentially of:

Zinc chloride: from 100 to 400 g/l, at least one substance selected from the group consisting of ammonium chloride and potassium chloride: from 100 to 400 g/l, and at least one substance selected from the group consisting of saturated carboxylic acid, sodium salt thereof and potassium salt thereof: from 1 to 70 g/l.

Now, the reasons why the chemical composition of the acidic electro-galvanizing solution of the present invention is limited as mentioned above are described below.

(1) Zinc Chloride

Zinc chloride is used as the main source for supply of zinc. However, with a zinc chloride content of under 100 g/l, an allowable electric current density becomes lower, and as a result, a necessary electric current density cannot be obtained when using a higher line speed. With a zinc chloride content of over 400 g/l, on the other hand, a portion of zinc chloride not as yet dissolved remains in the galvanizing solution and exerts an adverse effect on the electro-galvanizing operation. Therefore, the zinc chloride content should be limited within the range of from 100 to 400 g/l.

(2) Ammonium Chloride and Potassium Chloride:

Ammonium chloride and potassium chloride are used as an electric conductivity assistant. However, with a total amount of an ammonium chloride content and/or a potassium chloride content of under 100 g/l, an electric conductivity assisting effect as desired cannot be obtained. With a total amount of an ammonium chloride content and/or a potassium chloride content of over 400 g/l, on the other hand, ammonium chloride and/or potassium chloride remain in the galvanizing bath in the form of crystal when the temperature of the galvanizing bath goes down, which in turn affects the electro-galvanizing operation. Therefore, the content of at least one substance selected from the group consisting of ammonium chloride and potassium chloride should be limited within the range of from 100 to 400 g/l.

(3) Saturated Carboxylic Acid, Sodium Salt thereof and Potassium Salt thereof:

Steel sheets were electro-galvanized under the following conditions:

(a) Kind and chemical composition of the acidic electro-galvanizing solution used:
  (i) the chloride galvanizing solution comprising:
    zinc chloride ($ZnCl_2$): 300 g/l, and
    potassium chloride (KCl): 300 g/l;
  (ii) the sulfate galvanizing solution comprising:
    zinc sulfate ($ZnSO_4 0.7H_2O$): 400 g/l, and
    sodium sulfate ($Na_2SO_4$): 100 g/l;
(b) Electric current density: 80 A/dm$^2$;
(c) Bath temperature: 50° C.; and
(d) pH value: 4;

and investigation was made on the relationship between the $Fe^{2+}$ ion concentration in the galvanizing solution and the amount of the anode sludge produced on the surface of the zinc electrode after the lapse of 40 hours, 80 hours, and 120 hours, respectively, from the start of electro-galvanizing. The result of this investigation is shown in FIG. 1.

As is clear from FIG. 1, although the chloride galvanizing solution and the sulfate galvanizing solution have the same pH value, the rate of increase of $Fe^{2+}$ ions in the chloride galvanizing solution is higher than that in the sulfate galvanizing solution. In addition, although the chloride galvanizing solution and the sulfate galvanizing solution have almost the same $Fe^{2+}$ ion concentrations, the amount of the produced anode sludge is larger in the chloride galvanizing solution than in the sulfate galvanizing solution. For the both galvanizing solutions, the amount of the produced anode sludge increases according as the $Fe^{2+}$ ion concentration becomes higher, as is understood from FIG. 1.

In the above-mentioned chloride galvanizing solution, the anode sludge adhered onto the surface of the steel sheet after the lapse of about 50 hours from the start of electro-galvanizing, and black dots were produced on the surface of the steel sheet. Furthermore, dent defects were caused on the surface of the steel sheet due to adhesion of the anode sludge onto the surfaces of the rolls. Analysis of the chemical composition of the anode sludge revealed that the anode sludge mainly comprised metallic iron.

Then, a steel sheet was electro-galvanized under the following conditions:

(a) Kind and chemical composition of the acidic electro-galvanizing solution used:
  the chloride galvanizing solution comprising:
    zinc chloride ($ZnCl_2$): 300 g/l,
    potassium chloride (KCl): 300 g/l, and
    $Fe^{2+}$ ions as impurities: 0–500 ppm;
(b) Electric current density: 10 A/dm$^2$;
(c) Bath temperature: 50° C.;
(d) pH value: 4; and
(e) Electro-galvanizing time: 6 hours;

and investigation was made on the relationship between the $Fe^{2+}$ ion concentration in the galvanizing solution and the amount of the anode sludge produced on the surface of the zinc electrode. The result of this investigation is shown in FIG. 2.

Figure 2:
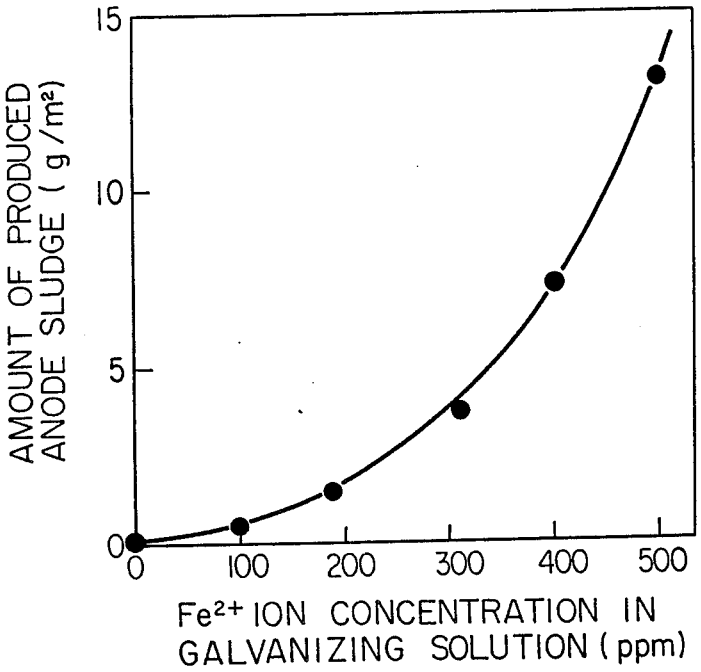
FIG. 2 is a graph illustrating the relationship between the $Fe^{2+}$ ion concentration and the amount of the produced anode sludge in a galvanizing solution when a steel sheet is electro-galvanized with the use of the chloride galvanizing solution not containing any of saturated carboxylic acid, sodium salt thereof and potassium salt thereof, but containing $Fe^{2+}$ ions in a certain amount as impurities.

Just as in FIG. 1, it is understood from FIG. 2 that the amount of the produced anode sludge increases according as the $Fe^{2+}$ ion concentration in the galvanizing solution becomes higher.

The results shown in FIGS. 1 and 2 prove that $Fe^{2+}$ ions in the galvanizing solution are transferred into metallic iron and metallic iron is precipitated due to the formation of a local battery on the surface of the zinc electrode, whereby the anode sludge is produced.

It is further understood from FIG. 2 that even in the chloride galvanizing solution, the amount of the produced anode sludge can be inhibited to a low level if the $Fe^{2+}$ ion concentration in the galvanizing solution is very low.

When continuously electro-galvanizing a steel sheet with the use of the chloride galvanizing solution, however, the dissolving rate of $Fe^{2+}$ ions from the steel sheet is very high, so that removal of $Fe^{2+}$ ions from the galvanizing solution in response to the amount of dissolved $Fe^{2+}$ ions requires a very large-scaled equipment and a high operating cost.

Therefore, for the purpose of studying the chemical composition of the cloride galvanizing solution which permits prevention of precipitation of $Fe^{2+}$ ions in the form of metallic iron in a large amount onto the surface of the zinc electrode even when $Fe^{2+}$ ions are mixed into the galvanizing solution, a steel sheet was electro-galvanized under the following conditions:

(a) Kind and chemical composition of the acidic electro-galvanizing solution used:
  the chloride galvanizing solution comprising:
    zinc chloride ($ZnCl_2$): 300 g/l,
    potassium chloride (KCl): 300 g/l,
    sodium succinate ($Na_2C_4H_4O_4.6H_2O$): 0–40 g/l, and
    $Fe^{2+}$ ion as impurities: 500 ppm;
(b) Electric current density: 10 A/dm$^2$;
(c) Bath temperature: 50° C.;
(d) pH value 4; and
(e) electro-galvanizing time: 6 hours;

and investigation was made on the relationship between the sodium succinate content in the galvanizing solution and the amount of the anode sludge produced on the surface of the zinc electrode. The result of this investigation is shown in FIG. 3.

Figure 3:
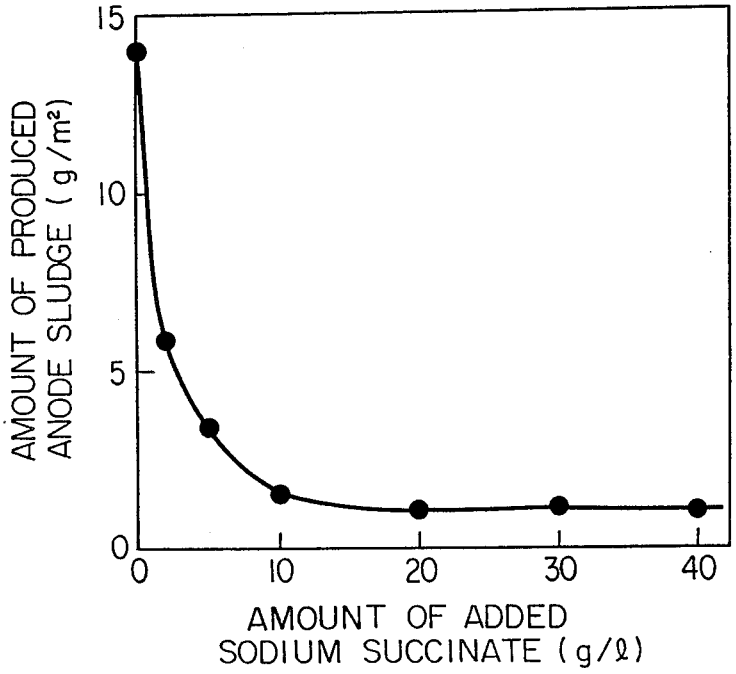
FIG. 3 is a graph illustrating the relationship between the sodium succinate content and the amount of the produced anode sludge in a galvanizing solution when a steel sheet is electro-galvanized with the use of the chloride galvanizing solution containing sodium succinate in a certain amount as sodium salt of saturated carboxylic acid and $Fe^{2+}$ ions in a certain amount as impurities.

As is clear from FIG. 3, addition of sodium succinate largely reduces the amount of the produced anode sludge.

Subsequently, a steel sheet was electro-galvanized under the following conditions:

(a) Kind and chemical composition of the acidic electro-galvanizing solution used:
  the chloride galvanizing solution comprising:
    zinc chloride ($ZnCl_2$): 300 g/l,
    potassium chloride (KCL): 300 g/l, and
    any one substance selected from the group consisting of saturated carboxylic acid, sodium salt of saturated carboxylic acid other than sodium succinate, and potassium salt of saturated carboxylic acid: a certain amount;
(b) Electric current density: 10 A/dm$^2$;
(c) Bath temperature: 50° C.;
(d) pH value: 4; and
(e) Electro-galvanizing time: 6 hours;

and investigation was made on the relationship between the content of any one substance selected from the group consisting of saturated carboxylic acid, sodium salt of saturated carboyxlic acid other than sodium succinate, and potassium salt of saturated carboxylic acid in the galvanizing solution, and the amount of the anode sludge produced on the zinc electrode. The result of this investigation is shown in Table 1, together with the result in the case with the use of the chloride galvanizing solution not containing any of saturated carboxylic acid, sodium salt thereof and potassium salt thereof.

TABLE 1

| Substance added to chloride galvanizing solution comprising 300 g/l $ZnCl_2$ and 300 g/l KCl | Amount of addition (g/l) | Amount of produced anode sludge ($g/m^2$) |
|---|---|---|
| Acetic acid ($CH_3COOH$) | 2 | 1.2 |
| Lactic acid ($CH_3CH(OH)COOH$) | 2 | 1.8 |
| Malonic acid ($CH_2(COOH)_2$) | 2 | 1.7 |
| Adipic acid ($HOOC(CH_2)_4COOH$) | 2 | 2.0 |
| Citric acid ($C_6H_8O_7$) | 2 | 1.4 |
| Sodium acetate ($NaCH_3COO$) | 20 | 0.7 |
| Sodium butyrate ($CH_3(CH_2)_2COONa$) | 20 | 1.3 |
| Sodium malonate ($CH_2(COONa)_2$) | 20 | 2.1 |
| Sodium citrate ($Na_3C_6H_5O_7.2H_2O$) | 30 | 0.8 |
| Sodium gluconate ($NaC_6H_{11}O_7$) | 40 | 0.9 |
| Potassium tartrate ($K_2C_4H_4O_6$) | 30 | 0.8 |
| None | — | 14.2 |

As is clear from Table 1, it is possible to considerably reduce the amount of the produced anode sludge by adding any of saturated carboxylic acid, sodium salt thereof and potassium salt thereof in a certain amount as shown in Table 1 to the chloride galvanizing solution.

Also in the case of succinic acid and tartaric acid as the saturated carboxylic acid, a similar effect of inhibiting production of the anode sludge was observed with almost the same amount of addition as in the case of acetic acid. For potassium citrate as potassium salt of saturated carboxylic acid also, a similar effect of inhibiting production of the anode sludge was observed with almost the same amount of addition as in the case of potassium tartrate.

As is evident from the above description, it is possible to considerably reduce the amount of the produced anode sludge not only by adding sodium succinate to the chloride galvanizing solution, but also by adding any of saturated carboxylic acid, other sodium salt of saturated carboxylic acid and potassium salt of saturated carboxylic acid in a certain amount to the chloride galvanizing solution.

It is needless to mention that it is possible to reduce the amount of the produced anode sludge by adding two or more substances selected from the group consisting of saturated carboxylic acid, sodium salt thereof and potassium salt thereof.

The reasons why production of the anode sludge is inhibited by adding at least one substance selected from saturated carboxylic acid, sodium salt thereof and potassium salt thereof to the chloride galvanizing solution are not as yet fully clarified. However, considering the fact that sodium succinate, for example, as sodium salt of saturated carboxylic acid is known to have the function of serving as a pH buffer and chelating agent of metal ions, a pH buffer and a chelating agent, which do not contain a carboxyl radical, were added to the chloride galvanizing solution, and the effect thereof was investigated. As a result, the effect of inhibiting production of the anode sludge was not observed in these pH buffer and chelating agent. It is estimated from this finding that carboxylic acid, sodium salt thereof and potassium salt thereof, which contain a carboxyl radical, have an intrinsic function of inhibiting production of the anode sludge.

Investigation was made also on the function of inhibiting production of the anode sludge of aromatic carboxylic acid and unsaturated carboxylic acid other than saturated carboxylic acid shown in Table 1. The function of inhibiting production of the anode sludge of these acids was far inferior to that of saturated carboxylic acid, and furthermore, it was revealed that addition of aromatic carboxylic acid and unsaturated carboxylic acid in a large amount to the chloride galvanizing solution caused deterioration of the exterior appearance and quality of the electro-galvanized steel sheet.

Presence of the function of inhibiting production of the anode was investigated on acids having different number of the carboxyl radical such as monocarboxylic acid, dicarboxylic acid, and tricarboxylic acid from among saturated carboxylic acids. In all cases, satisfactory function of inhibiting production of the anode sludge was observed.

For these reasons, in addition to zinc chloride in an amount of from 100 to 400 g/l and at least one substance selected from the group consisting of ammonium chloride and potassuim chloride in an amount of from 100 to 400 g/l, at one substance selected from the group consisting of saturated carboxylic acid, sodium salt thereof and potassium salt thereof is added, in the present invention, to the chloride galvanizing solution.

Now, the reasons why the content of at least one substance selected from the group consisting of saturated carboxylic acid, sodium salt thereof and potassium salt thereof is limited within the range of from 1 to 70 g/l are described.

A steel sheet was electro-galvanized under the following conditions:

(a) Kind and chemical composition of acidic electro-galvanizing solution used:

the chloride galvanizing solution comprising:

zinc chloride ($ZnCl_2$): 300 g/l, potassium cloride (KCl): 300 g/l, and sodium succinate ($Na_2C_4H_4O_4.6H_2O$): 1 g/l, 15 g/l and 70 g/l, respectively;

(b) Electric current density: 80 $A/dm^2$; (c) Bath temperature 50° C.; and (d) pH value: 4;

and investigation was made on the relationship between the content of sodium succinate in the galvanizing solution, which is a typical example of the substance having the function of inhibiting production of the anode sludge, the $Fe^{2+}$ ion concentration in the galvanizing solution after the lapse of 40 hours, 80 hours and 120 hours, respectively, from the start of electro-galvanizing, and the amount of the anode sludge produced on the surface of the zinc electrode. The result of this investigation is shown in FIG. 4.

Figure 4:
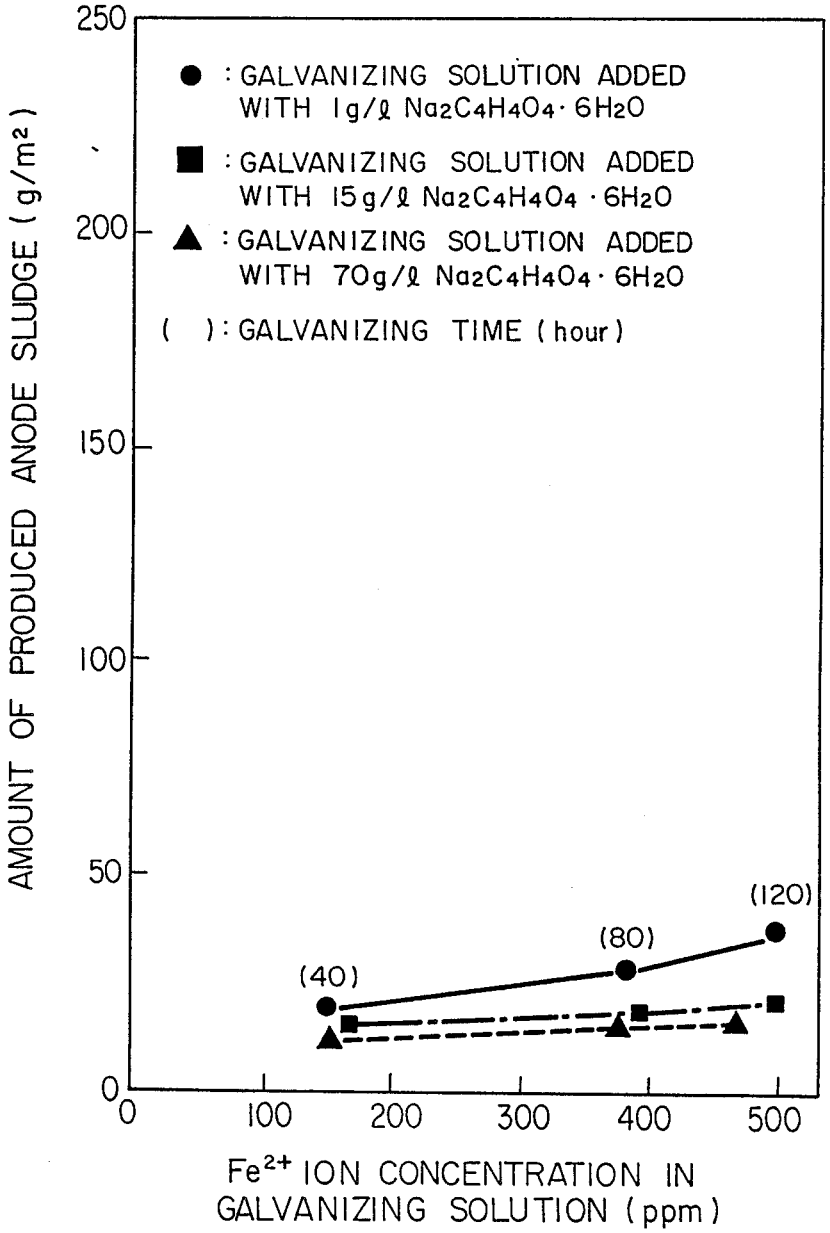
FIG. 4 is a graph illustrating the relationship between the sodium succinate content, the $Fe^{2+}$ ion concentration and the amount of the produced anode sludge in a galvanizing solution when a steel sheet is electro-galvanized with the use of the chloride galvanizing solution containing sodium succinate in a certain amount as sodium salt of saturated carboxylic acid.

As is clear from FIG. 4, the function of inhibiting production of the anode sludge becomes more remarkable according as the sodium succinate content becomes higher. However, with a sodium succinate content of under 1 g/l, a leisure effect cannot be obtained. With a sodium succunate content of over 70 g/l, on the other hand, the exterior appearance of the electro-galvanized steel sheet deteriorates. This is also the case with saturated carboxylic acid, sodium salt of saturated carboxylic acid other than sodium succinate, and potassium salt of saturated carboxylic acid.

Therefore, the content of at least one substance selected from the group consisting of saturated carboxylic acid, sodium salt thereof and potassium salt thereof should be limited within the range of from 1 to 70 g/l.

With a pH value of chloride galvanizing solution of under 1, the electrode is rapidly dissolved, and with a pH value of over 6, on the other hand, hydroxides tend to easily precipitate in the galvanizing solution. In the present invention, therefore, the pH value of the chloride galvanizing solution should be limited within the range of from 1 to 6, and more preferably, within the range of from 2 to 5.

Now, the acidic electro-galvanizing solution of the present invention is described further in detail, by means of an example while comparing with a case for comparison.

EXAMPLE

A steel sheet was electro-galvanized under the conditions as shown in Table 2, and the amount of the anode sludge produced on the surface of the zinc electrode was measured. Investigation was made also on the exterior appearance of the thus manufactured electro-galvanized steel sheet particularly on the presence of black dots appearing on the surface thereof as a result of adherence of the anode sludge onto the surface of the electro-galvanized steel sheet, and the presence of dent defects formed on the surface of the electro-galvanized steel sheet as a result of adherence of the anode sludge onto the surfaces of the rolls of the electro-galvanizing apparatus. The results of these investigations are also shown in Table 2.

sodium salt thereof and potassium salt thereof, in contrast, the amount of the produced anode sludge is more than ten times as large as those in the electro-galvanizing solutions of the present invention Nos. 1 to 5. Furthermore, several black dots per square meter of the steel sheet caused by the anode sludge are produced on the surface of the electro-galvanized steel sheet manufactured with the use of the electro-galvanizing solution for comparison No. 1, and this electro-galvanized steel sheet has an inferior exterior appearance.

As shown in Table 2, in the electro-galvanizing solutions of the present invention Nos. 6 to 8 and the electro-galvanizing solutions for comparison Nos. 3 and 4, electro-galvanizing conditions different from those applied to the electro-galvanizing solutions of the present invention Nos. 1 to 5 and the electro-galvanizing solutions for comparison Nos. 1 and 2, were applied in terms of the kind of the electro-galvanizing apparatus, the electric current density, the line speed and the electro-galvanizing time.

As is clear from Table 2, also is the electro-galvanizing solutions of the present invention Nos. 6 to 8, which are the chloride galvanizing solutions, the amount of the produced anode sludge is as small as in the electro-gal-

TABLE 2

| | Chemical composition of galvinizing solution | Kind of galvinizing apparatus | Current density ($A/dm^2$) | Line speed (m/minute) | Bath temperature (°C.) | PH value | galvanizing time (hour) | Amount of produced anode sludge ($g/m^2$) | Exterior appearance of manufactured electro-galvinized steel sheet |
|---|---|---|---|---|---|---|---|---|---|
| | | | galvinizing solution of the present invention | | | | | | |
| 1 | 350 g/l $ZnCl_2$ + 200 g/l $NH_4Cl$ + 10 g/l $Na^2CH_3COO$ | Vertical | 60 | 120 | 55 | 4 | 40 | 7 | Good |
| 2 | 300 g/l $ZnCl_2$ + 300 g/l $NH_4Cl$ + 40 g/l $Na_2C_4H_4O_4 \cdot 6H_2O$ | Vertical | 60 | 120 | 40 | 4 | 40 | 10 | Good |
| 3 | 300 g/l $ZnCl_2$ + 300 g/l KCl + 20 g/l $Na_2C_4H_4O_4 \cdot 6H_2O$ | Vertical | 60 | 120 | 50 | 4 | 40 | 8 | Good |
| 4 | 300 g/l $ZnCl_2$ + 300 g/l KCl + 2 g/l $C_6H_8O_7$ | Vertical | 60 | 120 | 50 | 3 | 40 | 10 | Good |
| 5 | 200 g/l $ZnCl_2$ + 350 g/l KCl | Vertical | 60 | 120 | 50 | 4 | 40 | 8 | Good |
| | | | galvinizing solution for comparison | | | | | | |
| 1 | 300 g/l $ZnCl_2$ + 300 g/l $NH_4CL$ | Vertical | 60 | 120 | 50 | 4 | 40 | 107 | Several black dots/$m^2$ produced |
| 2 | 400 g/l $ZnSo_4 \cdot 7H_2O$ | Vertical | 60 | 120 | 50 | 4 | 40 | 10 | Good |
| | | | galvinizing solution of the present invention | | | | | | |
| 6 | 300 g/l $ZnCl_2$ + 300 g/l $NH_4Cl$ + g/l $NaCH_3COO$ | Horizontal | 100 | 70 | 50 | 4 | 120 | 18 | Good |
| 7 | 300 g/l $ZnCl_2$ + 300 g/l KCl + 15 g/l $a^1$ | Horizontal | 100 | 70 | 50 | 4 | 120 | 11 | Good |
| 8 | 200 g/l $ZnCl_2$ + 350 g/l $NH_4Cl$ + g/l $C_6H_8O_7$ + 5 g/l $Na_3C_6H_5O_7 \cdot 2H_2O$ | Horizontal | 100 | 70 | 50 | 4 | 120 | 20 | Good |
| | | | galvinizing solution for comparison | | | | | | |
| 3 | 300 g/l $ZnCl_2$ + 300 g/l $NH_4Cl$ | Horizontal | 100 | 70 | 50 | 4 | 120 | 267 | Black dots and dent defects produced |
| 4 | 400 g/l $ZnSO_4 \cdot 7H_2O$ + 100 g/l $Na_2SO_4$ | Horizontal | 100 | 70 | 50 | 4 | 120 | 22 | Good |

As is clear from Table 2, in the electro-galvanizing solutions of the present invention Nos. 1 to 5, which are the chloride galvanizing solutions, the amount of the produced anode sludge is as small as in the electro-galvanizing solution for comparison No. 2, which is the sulfate galvanizing solution. Furthermore, no black dot or dent defect caused by the anode sludge is observed on the surfaces of the electro-galvanized steel sheets manufactured with the use of the electro-galvanizing solutions of the present invention Nos. 1 to 5, and these electro-galvanized steel sheets have a satisfactory exterior appearance. In the electro-galvanizing solution for comparison No. 1, which is the chloride galvanizing solution not containing any of saturated carboxylic acid, vanizing solution for comparison No. 4, which is the sulfate galvanizing solution. Furthermore, no black dot or dent defect caused by the anode sludge is observed on the surfaces of of the electro-galvanized steel sheets manufactured with the use of the electro-galvanizing solutions of the present invention Nos. 6 to 8, and these electro-galvanized steel sheets have a satisfactory exterior appearance. In the electro-galvanizing solution for comparison No. 3, which is the chloride galvanizing solution not containing any of saturated carboxylic acid, sodium salt thereof and potassium salt thereof, in contrast, the amount of the produced anode sludge is more than thirteen times as large as those in the electro-galvanizing solutions of the present invention Nos. 6 to 8.

Furthermore, black dots and dent defects caused by the anode sludge are produced on the electro-galvanized steel sheet manufactured with the use of the electro-galvanizing solution for comparison No. 3, and this electro-galvanized steel sheet has an inferior exterior appearance.

In the case where any of succinic acid, acetic acid, lactic acid, malonic acid, adipic acid and tartaric acid was used as saturated carboxylic acid in place of citric acid contained in the electro-galvanizing solutions of the present invention Nos. 4 to 8, the effect similar to those in the electro-galvanizing solutions of the present invention Nos. 4 and 8 was obtained.

Also in the case where any of sodium butyrate, sodium malonate and sodium gluconate was used as sodium salt of saturated carboxylic acid in place of sodium succinate, sodium acetate and sodium citrate which were contained in the electro-galvanizing solutions of the present invention Nos. 1 to 3 and 6 to 8, the effect similar to those in the electro-galvanizing solutions of the present invention Nos. 1 to 3 and 6 to 8 was obtained.

Also in the case where potassium citrate was used as potassium salt of saturated carboxylic acid in place of potassium tartrate contained in the electro-galvanizing solution of the present invention No. 5, the effect similar to that in the electro-galvanizing solution of the present invention No. 5 was obtained.

According to the acidic electro-galvanizing solution of the present invention, as described above in detail, it is possible to manufacture an electro-galvanized steel sheet having a satisfactory quality by largely inhibiting production of the anode sludge, which is the most detrimental defect of the conventional chloride galvanizing solution, without impairing the low electric power cost and the high productivity, which are the favorable merits of the chloride galvanizing solution, thus providing industrially useful effects.

What is claimed is:

1. An acidic aqueous electro-galvanizing solution consisting essentially of:

zinc chloride: from 100 to 400g/l, at least one substance selected from the group consisting of ammonium chloride and potassium chloride: from 100 to 400 g/l, and at least one substance selected from the group consisting of saturated carboxylic acid, sodium salt thereof and potassium salt thereof: from 1 to 70 g/l.

2. The acidic electro-galvanizing solution as claimed in claim 1, wherein:

at least one substance selected from the group consisting of succinic acid, acetic acid, lactic acid, malonic acid, adipic acid, tartaric acid and citric acid is used as said saturated carboxylic acid.

3. The acidic electro-galvanizing solution as claimed in claim 1, wherein:

at least one substance selected from the group consisting of sodium succinate, sodium acetate, sodium butyrate, sodium malonate, sodium citrate and sodium gluconate is used as said sodium salt of said saturated carboxylic acid.

4. The acidic electro-galvanizing solution as claimed in claim 1, wherein:

at least one substance selected from the group consisting of potassium tartrate and potassium citrate is used as said potassium salt of said saturated carboyxlic acid.

5. The acidic electro-galvanizing solution as claimed in claim 1, wherein:

said acidic electro-galvanizing solution consists essentially of:

zinc chloride: 300 g/l, ammonium chloride: 300 g/l, and sodium succinate as sodium salt of saturated carboxylic acid: 40 g/l.

6. The acidic electro-galvanizing solution as claimed in claim 1, wherein:

said acidic electro-galvanizing solution consists essentially of:

zinc chloride: 300 g/l, potassium chloride: 300 g/l, and sodium succinate as sodium salt of saturated carboxylic acid: 15 g/1.

7. The acidic electro-galvanizing solution as claimed in claim 1, wherein:

said acidic electro-galvanizing solution consists essentially of:

zinc chloride: 200 g/1, ammonium chloride: 350 g/l, citric acid as saturated carboxylic acid: 1 g/l, and sodium citrate as sodium salt of saturated carboxylic acid: 5 g/l.

8. The acidic electro-galvanizing solution as claimed in claim 1, wherein:

said zinc chloride is in an amount of 200–350 g/l, said at least one substance selected from the group consisting of ammonium chloride and potassium chloride is in an amount of from 200–350 g/l; and said at least one substance selected from the group consisting of saturated carboxylic acid, sodium salt thereof and potassium salt thereof is in an amount of from 2–40 g/l.

9. The acidic electro-galvanizing solution as claimed in any one of claims 1 to 8, wherein:

said acidic electro-galvanizing solution has a pH of 4.

10. The acidic electro-galvanizing solution as claimed in claim 1, wherein:

said acidic electro-galvanizing solution has a pH of 2–5.

* * * * *